United States Patent [19]

Schoenig

[11] Patent Number: 5,029,796

[45] Date of Patent: Jul. 9, 1991

[54] MUSICAL INSTRUMENT STAND

[75] Inventor: Darrell A. Schoenig, Fort Collins, Colo.

[73] Assignee: Ultimate Support Systems, Inc., Ft. Collins, Colo.

[21] Appl. No.: 548,117

[22] Filed: Jul. 5, 1990

[51] Int. Cl.[5] ..... G10G 5/00

[52] U.S. Cl. ..... 248/443; 84/327; 248/166; 248/447; 248/452

[58] Field of Search ..... 248/443, 447, 451, 452, 248/166, 167, 458, 461, 150, 165; 84/327

[56] References Cited

U.S. PATENT DOCUMENTS

| | | | |
|---|---|---|---|
| 1,612,148 | 12/1926 | Oettinger | 84/327 |
| 1,890,729 | 12/1932 | Ganson | 248/167 |
| 2,007,574 | 7/1935 | Lang | 248/167 |
| 2,552,921 | 5/1951 | Anderson | 248/167 |
| 4,084,778 | 4/1978 | Dominguez | 248/443 X |
| 4,215,838 | 8/1980 | Gullota | 248/167 X |
| 4,352,480 | 10/1982 | Gathright | 248/461 X |
| 4,582,282 | 4/1986 | Gracie | 248/167 |
| 4,943,021 | 7/1990 | Cien et al. | 248/167 |

*Primary Examiner*—Ramon O. Ramirez
*Attorney, Agent, or Firm*—Dean P. Edmundson

[57] ABSTRACT

A collapsible musical instrument stand is described which is light-weight and portable. The stand includes an upright spine with spaced-apart legs. A yoke member is pivotably attached to the upper end of the spine. A brace is attached between the legs and is pivotable between open and closed positions.

16 Claims, 4 Drawing Sheets

MUSICAL INSTRUMENT STAND

FIELD OF THE INVENTION

This invention relates to instrument stands. More particularly, this invention relates to stands or supports for musical instruments. Even more particularly, this invention relates to portable and collapsible stands for musical instruments.

BACKGROUNDS OF THE INVENTION

Musical instruments such as guitars, banjos, violins, etc. are very expensive and delicate instruments. Consequently, when such instruments are not being used they must be placed in a protective case or supported in a stable and secure manner. For example, while such instruments are not being used when they are on-stage, they are normally supported on a stand of one type or another.

Although various types of support stands have been previously used, they are characterized by various limitations and drawbacks. For example, some of them are not collapsible or readily transported from one location to another. Others are not very stable or secure for supporting expensive instruments. Some prior stands also are characterized by loose parts, sharp protrusions, or unattractive rivets which can loosen with wear.

There has not heretofore been provided a light-weight, collapsible musical instrument stand which is easy to use and which is capable of supporting a musical instrument in a safe and secure manner.

SUMMARY OF THE PRESENT INVENTION

In accordance with the present invention there is provided a light-weight musical instrument stand which is collapsible and easily carried from one location to another. In one embodiment the musical instrument stand comprises:

(a) an upright spine member including spaced-apart leg members;

(b) a yoke member pivotably attached to the upper end of the spine member; wherein the yoke member optionally includes retention means;

(c) a brace member pivotably supported between the leg members; the brace member including support means; wherein the brace member is pivotable between first and second positions.

When the brace member is in its first position, the spine member is supported in an upright position and the instrument can be supported on the support means. The yoke member helps to support the upper end of the instrument. When the brace member is in its second position, the stand is collapsed for transport and storage.

The instrument stand of the invention can be used for supporting a variety of musical instruments. It does not include loose parts which can become lost or broken. Furthermore, it can be composed of impact-resistant plastic with a very attractive and durable finish, without sharp protrusions.

Other advantages of the instrument stand of the invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
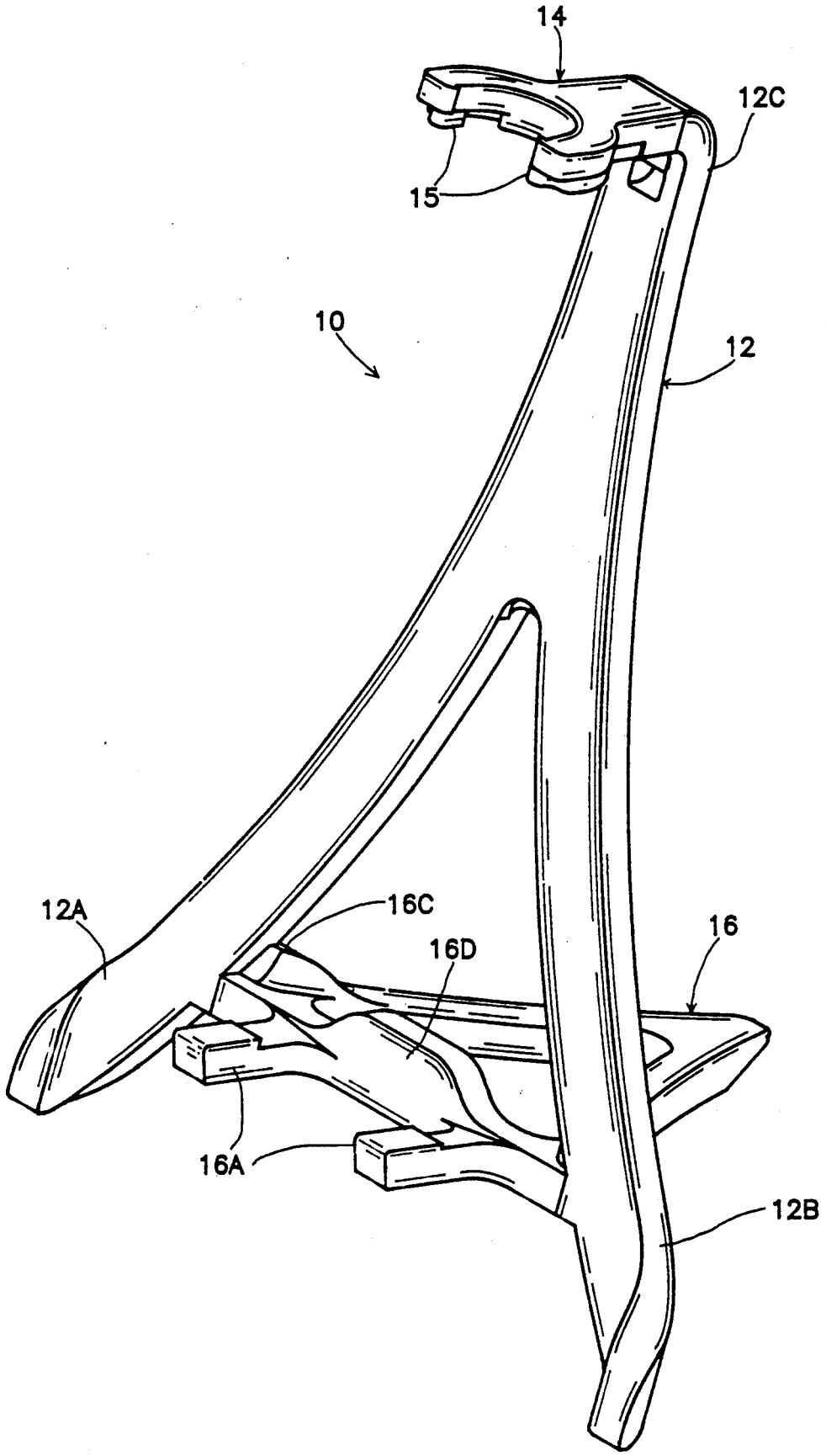
FIG. 1 is a perspective view of a preferred embodiment of musical instrument stand of the invention.
Figure 2:
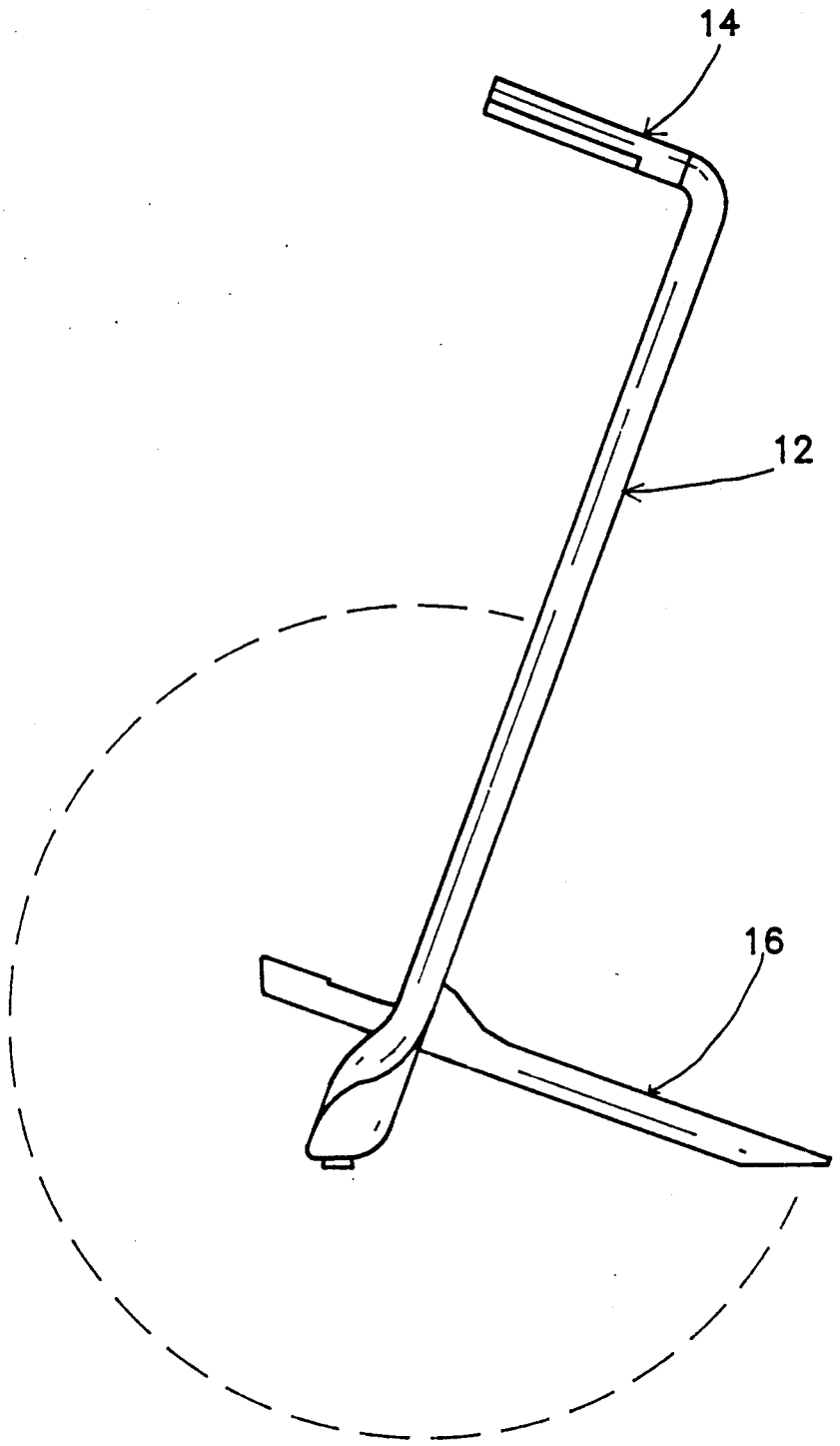
FIG. 2 is a side elevational view of the stand of FIG. 1.
Figure 3:
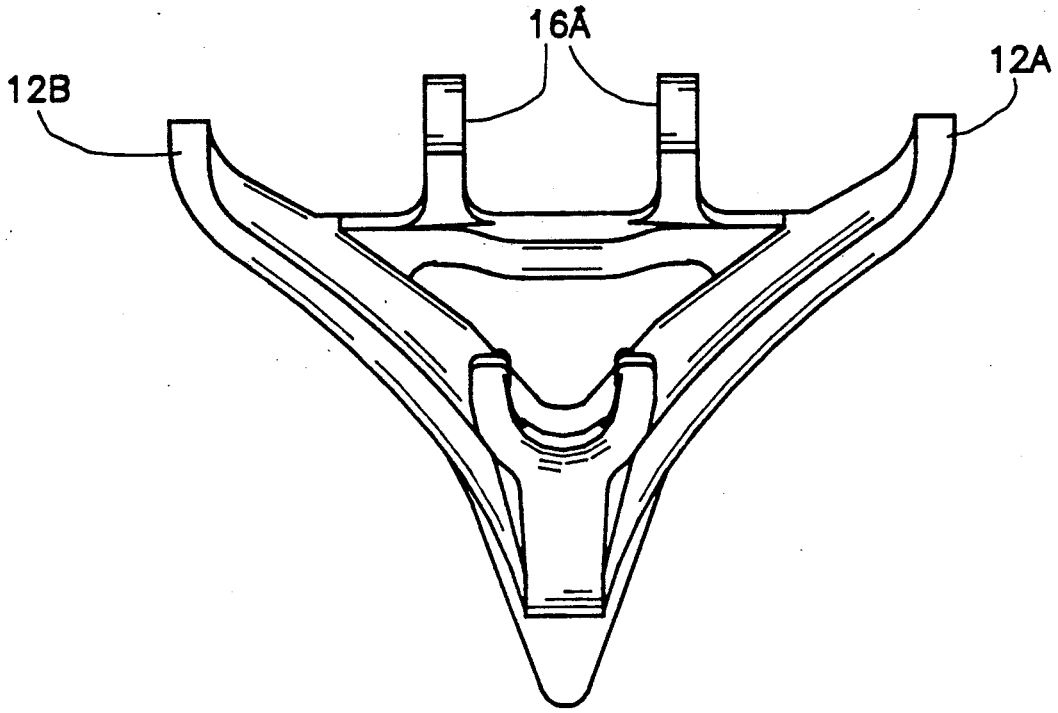
FIG. 3 is a top view of the instrument stand of FIG. 1.

In the drawings there is illustrated a preferred embodiment of musical instrument stand 10 of the invention. The stand includes an upright spine member 12 which includes spaced-apart leg members 12A and 12B.

Figure 5:
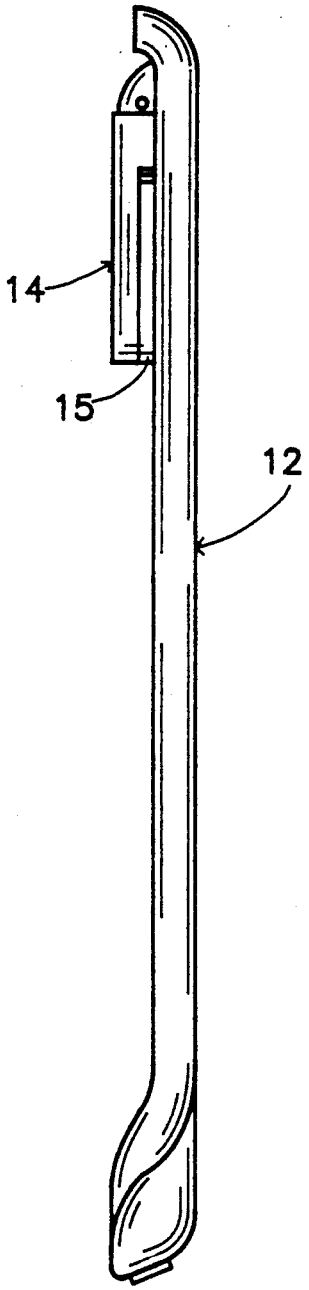
FIG. 5 is a side elevational view of the instrument stand of FIG. 1 in collapsed condition.

To the upper end 12C of spine member 12 there is pivotably attached a yoke member 14 which is pivotable between an upward position (e.g., as shown in FIG. 1) and a downward position (shown in FIG. 5).

Figure 4:
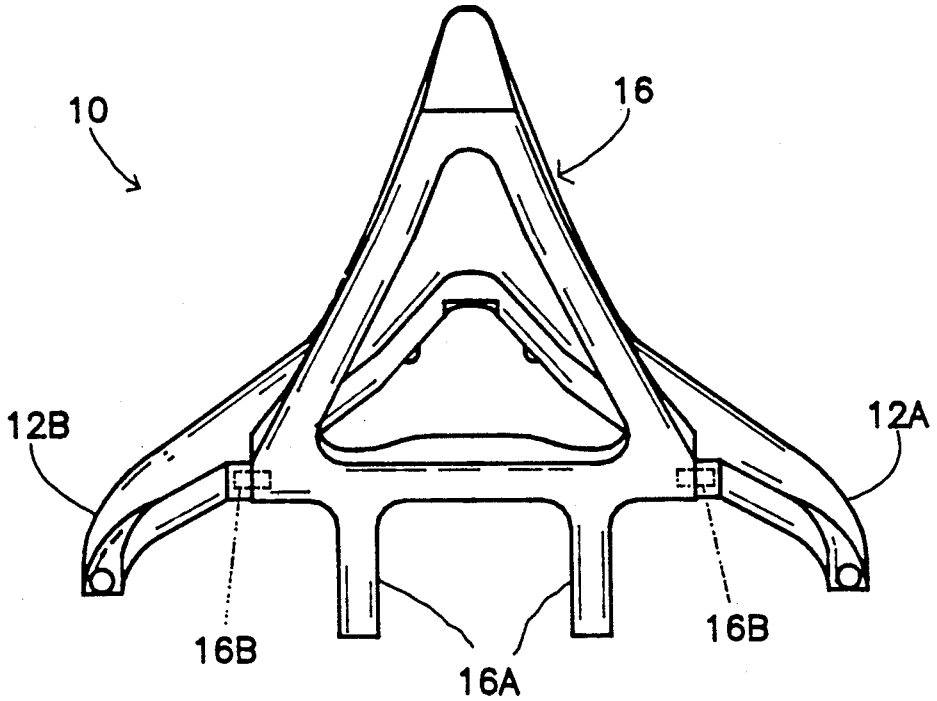
FIG. 4 is a bottom view of the stand of FIG. 1.

Between leg members 12A and 12B there is pivotably attached a brace member 16. Each side of the brace 16 may be supported by a peg or axle 16B which may extend into legs 12A and 12B (e.g., illustrated in FIG. 4). Alternatively, the pegs 16B may be carried by legs 12A and 12B and extend into brace 16 at opposite sides thereof. As another alternative, a hinge pin at each side could extend into the brace and also into an adjacent leg (12A or 12B).

Brace 16 is able to rotate or pivot between an open position (shown in FIGS. 1–4) and a closed position (FIG. 5) where it is received within the area between the legs 12A and 12B. This is a collapsed position for storage and transport.

Thus, in a preferred embodiment the brace member 16 has an external size and shape which is complementary to the opening between legs 12A and 12B. Accordingly, when the brace member is in its closed position, it is coplanar with the spine and leg members, as shown in the side view of FIG. 5. In the embodiment shown, the brace member pivots about 270° between its open and closed positions. Stop members 16C on brace 16 limit the pivotable movement of the brace in its open position.

The brace member 16 includes spaced-apart arm members 16A which are adapted to project forwardly of the legs and spine member when the brace member is in its down or open position. The arm members are spaced-apart about 4 to 16 inches. Typically they project forwardly of the leg members 12A and 12B about 2 to 12 inches.

The arm members 16A are for supporting the base or lower end of a musical instrument. Raised portion 16D helps to locate the instrument on arms 16A.

The upper end or neck of the instrument is able to be received within yoke 14. Retention fingers 15 are pivotably attached to yoke 14 and are movable between open and closed positions. When the fingers are in their closed position they are adapted to retain the neck of the instrument within the yoke and thereby prevent the upper end of the instrument from falling over while the instrument is in the stand. The fingers 15 do not actually have to touch or grip the upper end of the instrument so long as they close the opening in the yoke to prevent the upper end of the instrument from escaping.

Figure 6:
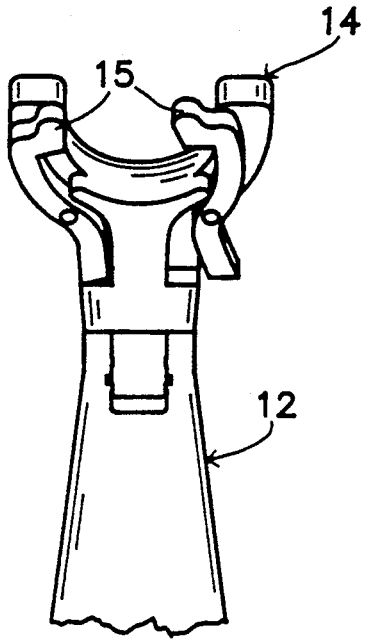
FIG. 6 is a front view of the upper end of the stand of FIG. 1.
Figure 7:
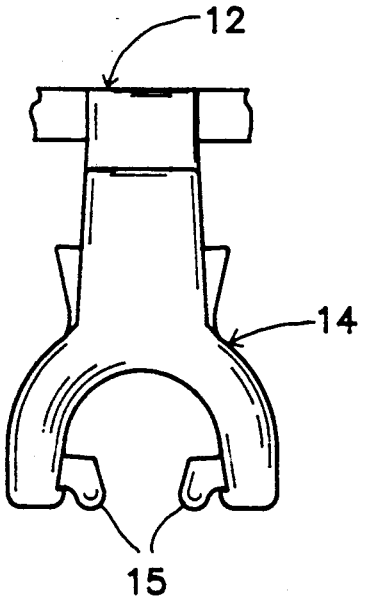
FIG. 7 is a top view of the upper end of the instrument stand.

FIG. 6 illustrates one of the fingers 15 in closed position and one in the open position. FIG. 7 illustrates both of the fingers in closed position.

In a preferred embodiment the instrument stand is only about two inches thick in its collapsed or folded position. This allows flat storage of the stand. Preferably yoke 14 and brace 16 include detents to assist in retaining these parts in their folded and unfolded positions.

Preferably the stand is composed of plastic for most economical construction and lightest weight. It is possible for the stand to be composed of metal, wood, or composite materials, but plastic is more economical. The components may be connected together in any desired manner using conventional materials. Preferably the components are all composed of plastic and are sized such that the brace 16 and yoke 14 can be snapped onto appropriate pegs or protrusions in the spine 12.

The shape of the components used in the instrument stand may also vary. For example, the cross-sectional configuration may be rectangular, square, etc. The components may be solid or hollow. The legs may be curved or straight. Other cosmetic variations are also possible.

Various types of instruments can be supported in the stand of the invention, e.g., acoustic and electric guitars (including bass, 6-string, 12-string, classical, western, jumbo body, headless, hollow body electrics, etc.), banjo, violin, cello, string bass, etc. Various wind instruments may also be supported in the stand so long as the brace 16 includes appropriate support means for the lower end of the instrument. Another variation is for the arms 16A to be telescoping so that they can be extended outwardly a greater distance to support instruments which are very thick or have a deep body.

Other variants are possible without departing from the present invention.

What is claimed is:

1. A collapsible musical instrument stand comprising:

(a) an upright spine member including spaced-apart leg members; said spine member including an upper end;

(b) a yoke member pivotably attached to said upper end of said spine member;

(c) a brace member pivotably supported between said leg members; said brace member including support means; wherein said brace member is pivotable between first and second positions;

wherein when said brace member is in said first position said spine member is supported in an upright position and said instrument can be supported on said support means and wherein when said brace member is in said second position said stand is collapsed for transport and storage.

2. An instrument stand in accordance with claim 1, wherein said yoke member is pivotable between (a) a first position in which said yoke member projects forwardly of said spine member, and (b) a second position in which said yoke member is adjacent said spine member.

3. An instrument stand in accordance with claim 1, wherein said yoke member includes retention means comprising a pair of opposing finger members which are pivotably secured to said yoke member; wherein said finger members are movable between open and closed positions.

4. An instrument stand in accordance with claim 1, wherein said leg members define a V-shaped opening therebetween, and wherein said brace member is V-shaped and is adapted to be received in said V-shaped opening when said brace member is in said second position.

5. An instrument stand in accordance with claim 1, wherein said support means comprises spaced-apart arm members.

6. An instrument stand in accordance with claim 1, wherein said brace member is adapted to pivot about 270° relative to said leg members.

7. An instrument stand in accordance with claim 6, wherein said yoke member includes retention means comprising a pair of opposing finger members which are pivotably secured to said yoke member; wherein said finger members are movable between open and closed positions.

8. A collapsible musical instrument stand comprising:

(a) an upright spine member including spaced-apart leg members; said spine member including an upper end; wherein said leg members define a V-shaped opening therebetween;

(b) a yoke member pivotably attached to said upper end of said spine member; wherein said yoke member includes retention means;

(c) a brace member pivotably supported between said leg members; said brace member including support means; wherein said brace member is pivotable between first and second positions; wherein said brace member is V-shaped and is adapted to be received in said V-shaped opening when said brace member is in said second position;

wherein when said brace member is in said first position said spine member is supported in an upright position and said instrument can be supported on said support means and be retained by said retention means; and wherein when said brace member is in said second position said stand is collapsed for transport and storage.

9. An instrument stand in accordance with claim 8, wherein said yoke member is pivotable between (a) a first position in which said yoke member projects forwardly of said spine member, and (b) a second position in which said yoke member is adjacent said spine member.

10. An instrument stand in accordance with claim 8, wherein said retention means comprises a pair of opposing finger members which are pivotably secured to said yoke member; wherein said finger members are movable between open and closed positions.

11. An instrument stand in accordance with claim 8, wherein said support means comprises spaced-apart arm members.

12. An instrument stand in accordance with claim 8, wherein said brace member is adapted to pivot about 270° relative to said leg members.

13. A collapsible musical instrument stand comprising:

(a) an upright spine member including spaced-apart leg members; said spine member including an upper end; wherein said leg members define a V-shaped opening therebetween;

(b) a yoke member pivotably attached to said upper end of said spine member; wherein said yoke member is pivotable between (i) a first position in which said yoke member projects forwardly of said spine member, and (ii) a second position in which said yoke member is adjacent said spine member; and wherein said yoke member includes retention means;

(c) a brace member pivotably supported between said leg members; said brace member including support means; wherein said brace member is pivotable between first and second positions; wherein said brace member is V-shaped and is adapted to be received in said V-shaped opening when said brace member is in said second position;

wherein when said brace member is in said first position said spine member is supported in an upright position and said instrument can be supported on said support means and be retained by said retention means; and wherein when said brace member and said yoke member are in their said second positions said stand is collapsed for transport and storage.

14. An instrument stand in accordance with claim 13, wherein said retention means comprises a pair of opposing finger members which are pivotably secured to said yoke member; wherein said finger members are movable between open and closed positions.

15. An instrument stand in accordance with claim 13, wherein said support means comprises spaced-apart arm members.

16. An instrument stand in accordance with claim 13, wherein said brace member is adapted to pivot about 270° relative to said leg members.

* * * * *